US007409319B2

(12) United States Patent
Kant et al.

(10) Patent No.: US 7,409,319 B2
(45) Date of Patent: Aug. 5, 2008

(54) METHOD AND APPARATUS FOR DETECTING RUB IN A TURBOMACHINE

(75) Inventors: Abhay Sudhakarrao Kant, Karnataka (IN); Vivek Venugopal Badami, Schenectady, NY (US); Joseph Robert Toth, Powder Springs, GA (US); Nicholas Giannakopoulos, Acworth, GA (US); Mark M. Dimond, Powder Springs, GA (US); Jitendra Kumar, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 31 days.

(21) Appl. No.: 10/720,817

(22) Filed: Nov. 24, 2003

(65) Prior Publication Data

US 2005/0114082 A1 May 26, 2005

(51) Int. Cl.
*G06F 15/00* (2006.01)

(52) U.S. Cl. ..... 702/188; 73/587; 73/593

(58) Field of Classification Search ..... 702/188, 702/38, 183; 324/207, 511; 62/141; 340/635, 340/647, 683, 679, 682; 208/157; 73/587, 73/593, 594

See application file for complete search history.

(56) References Cited

U.S. PATENT DOCUMENTS 4,478,082 A * 10/1984 Sato et al. ..... 73/593
4,502,046 A 2/1985 Wonn et al. ..... 340/682
4,563,675 A 1/1986 Miller et al. ..... 340/679
5,601,402 A * 2/1997 Wakeman et al. ..... 415/173.2
6,460,013 B1 * 10/2002 Nippes ..... 702/183
6,591,296 B1 * 7/2003 Ghanime ..... 709/224
2003/0192328 A1 * 10/2003 Kikuchi et al. ..... 62/141
2003/0222640 A1 * 12/2003 Twerdochlib et al. .. 342/207.17
2004/0060371 A1 * 4/2004 Barkhoudarian ..... 73/862.331

FOREIGN PATENT DOCUMENTS

EP 1533 479 * 5/2005

OTHER PUBLICATIONS http://www.cs.odu.edu/~hums/Reqmnt_diff_domains/paper4.pdf#search='monitor%20turbine%20internet', An internet-based Machinery Health Monitoring system, Rolf Orsagh, Mike Roemer, Ben Atkinson, Publish May, 2000, p. 1-8.* http://www.netl.doe.gov/publications/proceedings/02/turbines/colsher.pdf, Turbine Power Systems Conference, Feb. 25-26, 2002, p. 1-14.* http://en.wikipedia.org/wiki/Turbine, p. 1-5.*

Industrial Application of Gas Turbines Committee, Jeff Bird, Brian Galeote, Tim Breithaupt of National Research Council Institute for Aerospace Research Gas Turbine Laboratory Ottawa Ontario, Oct. 2007, p. 1-19.*

Turbomachinery Condition Monitoring and Failure Prognosis, Henry C. Pusey, SAVIAC/Hi-Test Laboratories, Winchester, Virginia, Mar. 2007, p. 2-12.*

Acoustic Emission for the detection of shaft-to-seal rubbing in large power generation turbines, M. Leahy, Advanced Materials Research, 2006, vols. 13-14, pp. 433-438.*

Daniel J. Clark and Mark J. Jansen, University of Toledo, Toledo, Ohio, An Overview of Magnetic Bearing Technology for Gas Turbine Engines, NASA/TM—2004-213177, Aug. 2004, p.1-8.*

* cited by examiner

*Primary Examiner*—Tung S Lau
(74) *Attorney, Agent, or Firm*—Fletcher Yoder

(57) ABSTRACT

An embodiment of the disclosed method and apparatus relates to a system for detecting a rub in a turbomachine. The system includes a turbomachine; sensors monitoring turbomachine conditions; and an on site monitor in communication with the sensors, and loaded with instructions to implement a method for detecting a rub in the turbomachine.

58 Claims, 14 Drawing Sheets

METHOD AND APPARATUS FOR DETECTING RUB IN A TURBOMACHINE

TECHNICAL FIELD

The current disclosed method and apparatus relate to the monitoring and diagnosis of turbomachine rubs. More specifically, the disclosed method and apparatus relate to using algorithms which analyze data obtained from sensors monitoring various turbomachine operating conditions to determine when a rub event is occurring.

BACKGROUND OF THE INVENTION

Turbomachines generally have a centrally disposed rotor that rotates within a stationary cylinder or shell. The working fluid flows through one or more rows of circumferentially arranged rotating blades that extend radially from the periphery of the rotor shaft and one or more rows of circumferentially arranged stator blades that extend centripetally from the interior surface of the shell to the rotor shaft. The fluid imparts energy to the shaft that is used to drive a load, such as an electric generator or compressor. In order to ensure that as much energy as possible is extracted from the fluid, the tips of the stator blades are usually very close to the seals located on the rotor surface, and the tips of the rotating blades are usually very close to the seals located on the internal surface of the shell. From the standpoint of thermodynamic efficiency, it is desirable that the clearance between the stator blade tips and the seals on the rotor surface, and between the rotating blade tips and the seals on the shell be maintained at a minimum so as to prevent excessive amounts of fluid from bypassing the row of rotating blades and stator blades.

Differential thermal expansion during operating conditions between the shell and the rotor results in variations in the tip clearances. In addition various operating conditions affect tip clearances—for example, tip clearances in gas turbine compressors often reach their minimum values during shutdown. Consequently, if insufficient tip clearance is provided at assembly, impact between the stator blade tips and rotor seals and impact between the seals on the shell and the rotating blade tips may occur when certain operating conditions are reached. These impacts are commonly known as "rubs." Also turbomachines are subjected to a variety of forces under various operating conditions, particularly during transient conditions, such as start-ups, shutdowns, and load changes. These forces may also cause rubs. Rubs may cause damage to the blades and seals of the turbomachine. Thus, a system of monitoring and diagnosing rub conditions in turbomachines is desirable.

Some systems have been developed to monitor and diagnose rubs. However, these systems are disadvantageous in that they require the use of very complicated and expensive vibration monitoring systems which are able to provide 1× and 2× amplitude, phase, polar and bode vibration data. Another disadvantage of these systems is that a rub determination is usually made only after subsequent analysis of the data and not made in real time.

Hence, a system of monitoring and diagnosing rub conditions in turbomachines using standard sensors and monitoring equipment already installed and around the turbomachine is desirable.

BRIEF DESCRIPTION OF THE INVENTION

An embodiment of the disclosed method and apparatus relates to a system for detecting a rub in a turbomachine. The system comprises: a turbomachine; sensors monitoring turbomachine conditions; and an on site monitor in communication with the sensors, and loaded with instructions to implement a method for detecting a rub in the turbomachine.

An embodiment of the disclosed method relates to a method for detecting a rub in a turbomachine, the method comprising: monitoring turbomachine conditions; and determining whether a rub is occurring.

Another embodiment of the disclosed apparatus relates to a storage medium encoded with a machine-readable computer program code for detecting a rub in a turbomachine, the storage medium including instructions for causing a computer to implement a method. The method comprises: obtaining data indicating turbomachine conditions; and determining whether a rub is occurring.

BRIEF DESCRIPTION OF THE DRAWINGS

Referring now to the figures, which are exemplary embodiments, and wherein like elements are numbered alike.

DETAILED DESCRIPTION OF THE INVENTION

A detailed description of several embodiments of the disclosed apparatus and method are presented herein by way of exemplification and not limitation with reference to FIGS. 1 through 14.

On Site Monitoring System

Figure 1:
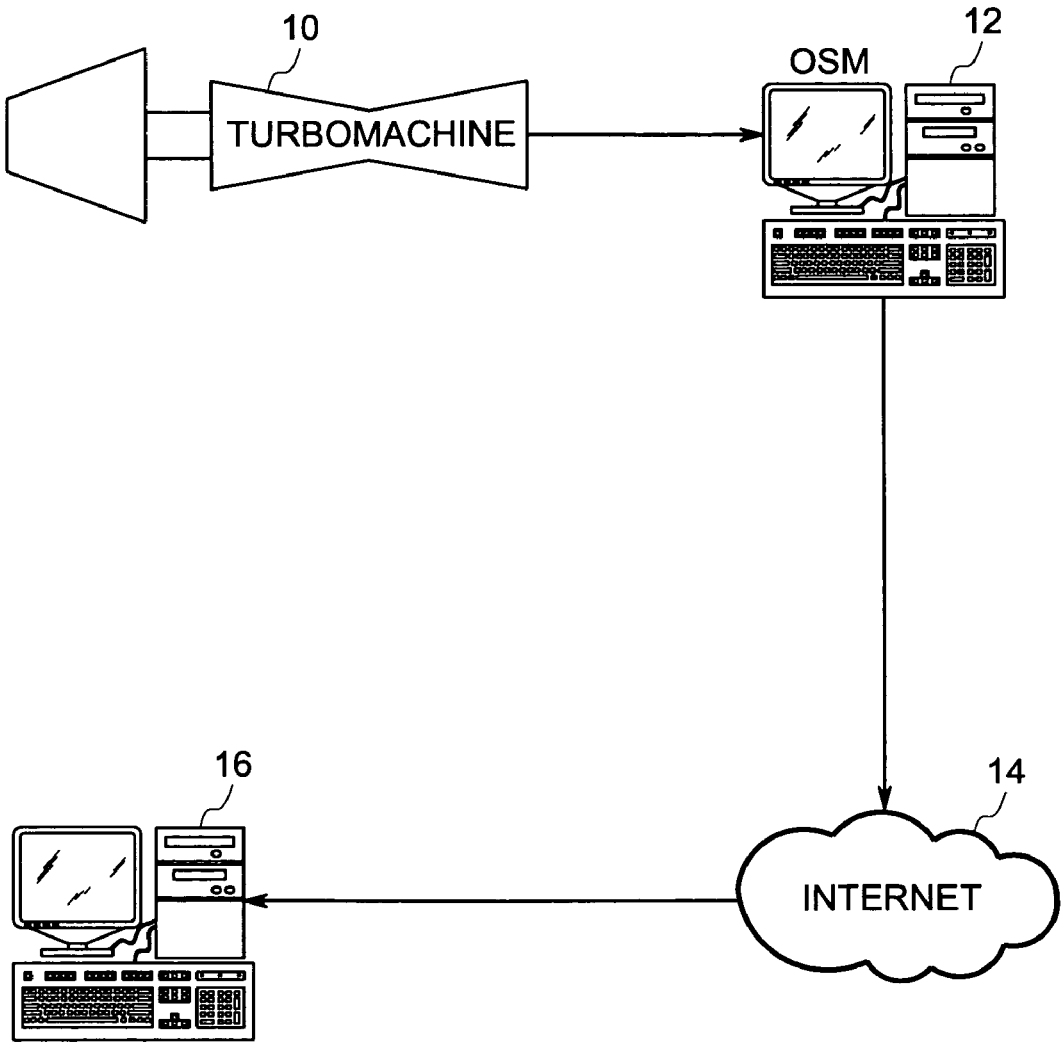
FIG. 1 depicts a view of the disclosed rub detection system.

FIG. 1 is a schematic depiction of one embodiment of the disclosed apparatus. A turbomachine 10 is shown. Monitoring the turbomachine and equipment coupled to the turbomachine are a variety of sensors. Signals from the sensors are communicated to an on site monitor 12. The on site monitor 12 may comprise a computer and may be configured to be a client communicatively coupled with a server 16 via an Internet or Intranet through a phone connection using a modem and telephone line (not shown) or other equivalent communication medium, in a standard fashion. The on site monitor 12 may alternatively be coupled to the server 16 via a network (e.g., LAN, WAN, etc.) connection. It will be apparent to those skilled in the art having the benefit of this disclosure that alternative means for networking an on site monitor 12 and a server 16 may also be utilized, such as a direct point to point connection using modems, satellite connection, direct port to port connection utilizing infrared, serial, parallel, USB, FireWire/IEEE-1394, and other means known in the art. In another embodiment, the on site monitor may simply comprise a controller unit for the turbomachine.

An advantage of the disclosed apparatus and method is that rub detection is achieved by using standard and common operational data that may already be communicated to the on site monitor 12. Such operational data may be obtained from previously installed sensors. Embodiments of the disclosed apparatus and method monitor bearing vibration (peak-to-peak displacement), temperature, pressure, eccentricity, axial displacement, load, and condsenser pressure values. The embodiments disclosed herein monitor a rub condition: 1) in near real time, 2) remotely, 3) with peak-to-peak vibration signals, and 4) by monitoring automatic event correlation, i.e. the presence of various conditions which are expected to occur or are normally observed during a rub condition.

From basic understanding of vibration theory, it is known that the vibration response of the system is a function of unbalance force and system stiffness. Vibration response is directly proportional to unbalance force and is inversely proportional to system stiffness. Thus any deviation in these values from the design condition or from baseline values will be reflected by change in vibration values. During a rub event, the rotor contacts the stator. This generates a huge impact force at the point of contact between the stator and the rotor. This impact force is responsible for giving rise to various conditions, which are specific to a rub anomaly. Therefore, when a rub event occurs, these various conditions are also observed. The newly developed algorithms disclosed herein use the correlation between an occurrence of a rub event and the appearance of these various conditions to detect a rub event. Some of the conditions observed during a rub events are: 1) sudden change in vibration values during steady speed operation, 2) axial noisiness during coast down of the unit, 3) abnormal eccentricity value when unit returns to turning gear after a rub event during deceleration, 4) abnormal vibration during start up followed by abnormal eccentricity when the unit was on turning gear, 5) abnormal vibration followed by abnormal upper and lower shell metal temperature difference, 6) high response to first critical speed, 7) high response to 2nd critical speed, 8) Overall vibration affected by variation in load, 9) Overall vibration affected by variation in condenser pressure, and 10) Abnormal vibration during abnormal differential expansion of stator and rotor. The disclosed apparatus and method use newly developed algorithms based on the above discussed correlations of various conditions with a rub event to detect rubs. These algorithms use information that may already be communicated to the on site monitor 12. Thus, in one embodiment of the disclosed method and apparatus, computer software incorporating the newly developed algorithms may be loaded into the on site monitor 12, thereby allowing rub detection without the need to purchase and install new hardware such sensors, cables and monitoring equipment.

The operational data discussed above may be obtained from signals communicated by various sensors related to the operation of the turbomachine. These sensors include vibration sensors which measure radial vibration near bearings of the turbomachine. Vibration sensors may include, but are not limited to, eddy current probes, accelerometers or vibration transducers. When reference is made to a low pressure bearing vibration, this is the radial vibration measurement taken on the bearing nearest the low pressure side of the turbomachine, usually near the outlet end. There are also axial vibration sensors, which measure the axial movement of the turbomachine rotor. In many turbomachine configurations, there are three axial vibration sensors, or axial probes, for redundancy purposes. Shaft eccentricity is another common operating condition that is also measured by sensors. Operators use eccentricity measurements to determine when a combination of slow roll and heating have reduced the rotor eccentricity to the point where the turbine can safely be brought up to speed without damage from excessive vibration or rotor to stator contact. Eccentricity is the measurement of rotor bow at rotor slow roll which may be caused by, but not limited to, any or a combination of: fixed mechanical bow; temporary thermal bow; and gravity bow. Usually eddy current probes are used to measure shaft eccentricity. Differential expansion measurements are an important parameter receiving much attention during turbine startup and warming. This parameter measures how the turbine rotor expands in relation to the turbine shell, or casing. Differential expansion is often measured using eddy current probes. Other important operating conditions for turbo machines such as steam turbines include shell metal temperature and steam inlet temperature both of which may be measured by temperature transducers such as thermocouples. Another important operating condition is condenser pressure which is measured by pressure transducers. Rotor speed may be measured in a variety of ways: observing a gear wheel located inside a front standard, electrically converting a generator output frequency, or monitoring a turning gear, eddy probes configured to observe any multi-toothed gear wheel. The load of the equipment, often a generator, being driven by the turbomachine is an important operating condition that is supplied to the on site monitor.

The on site monitor 12 may comprise a storage medium encoded with a machine-readable computer program code for detecting a rub in the turbomachine using inputs from the sensors described above. The computer program code may have instructions for causing a computer to implement the embodiments of the disclosed method described below.

The algorithms described in the embodiments below may be used to detect rub in a turbomachine using standard operating data from a turbomachine system without the need to purchase and install costly monitoring equipment that are able to provide 1× and 2× vibration data, bode' plots, and polar plots. The newly developed algorithms described in the embodiments below are able to detect rubs without the need of 1× and 2× data, bode' plots or polar plots, nor the need for subsequent analysis of turbomachine data.

Rub Associated with Sudden Large Shell Temperature Ramp

Figure 2:
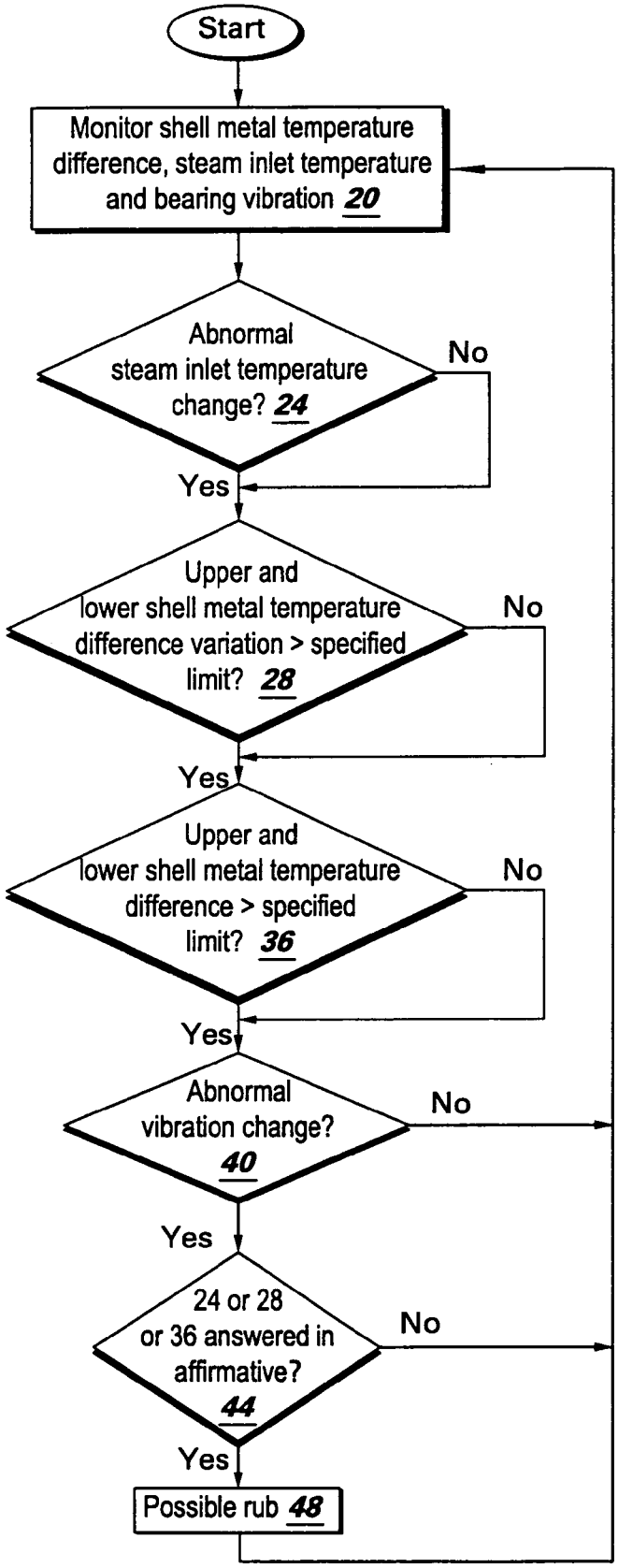
FIG. 2 depicts a flowchart illustrating a method for determining whether there is a rub associated with a sudden large shell temperature ramp.

Illustrated in FIG. 2 is a flowchart depicting an embodiment of a disclosed method for detecting a rub associated with a sudden large shell temperature ramp. At act 20, the on site monitor obtains data indicating shell metal temperature difference, steam inlet temperature difference and bearing vibration. At query 24, it is determined whether there has been an abnormal steam inlet temperature change. In one embodiment, any abnormal temperature change for any measured temperature would be indicated by either: (1) when there is a larger than specified change in amplitude over a specified time period or (2) temperature amplitude exceeds specified temperature amplitude limits for three consecutive data samples. Values for a larger than specified change in amplitude for steam inlet temperature amplitude is unit specific, but for many units, about a 50 degrees Fahrenheit change in steam inlet temperature over 60 seconds would be a larger than specified change. Similarly, specified temperature amplitude limits would be unit specific, but in some cases may be 1,075 degrees Fahrenheit for an upper limit and 1,050 degrees Fahrenheit for a lower limit. At query 28 it is determined whether there has been a variation, above a specified limit, in the difference between the upper and lower shell temperatures over time. A specified limit for query 28 would be a 30 degree Fahrenheit change in 60 seconds. At query 36 it is determined whether the upper and lower shell metal temperature difference is above a specified limit. In one embodiment, a specified limit for shell metal temperature difference is 50 degrees Fahrenheit for three consecutive samples that are received by the on site monitor 12. At query 40, it is determined whether there has been an abnormal vibration change. An embodiment discussing the act of when an abnormal vibration change 40 is indicated is discussed with respect to FIGS. 3 and 4. At query 44, it is determined whether any of queries 24-36 were answered in the affirmative. If any were answered in the affirmative, then at act 48, a possible rub is indicated.

Abnormal Vibration Change

Figure 3:
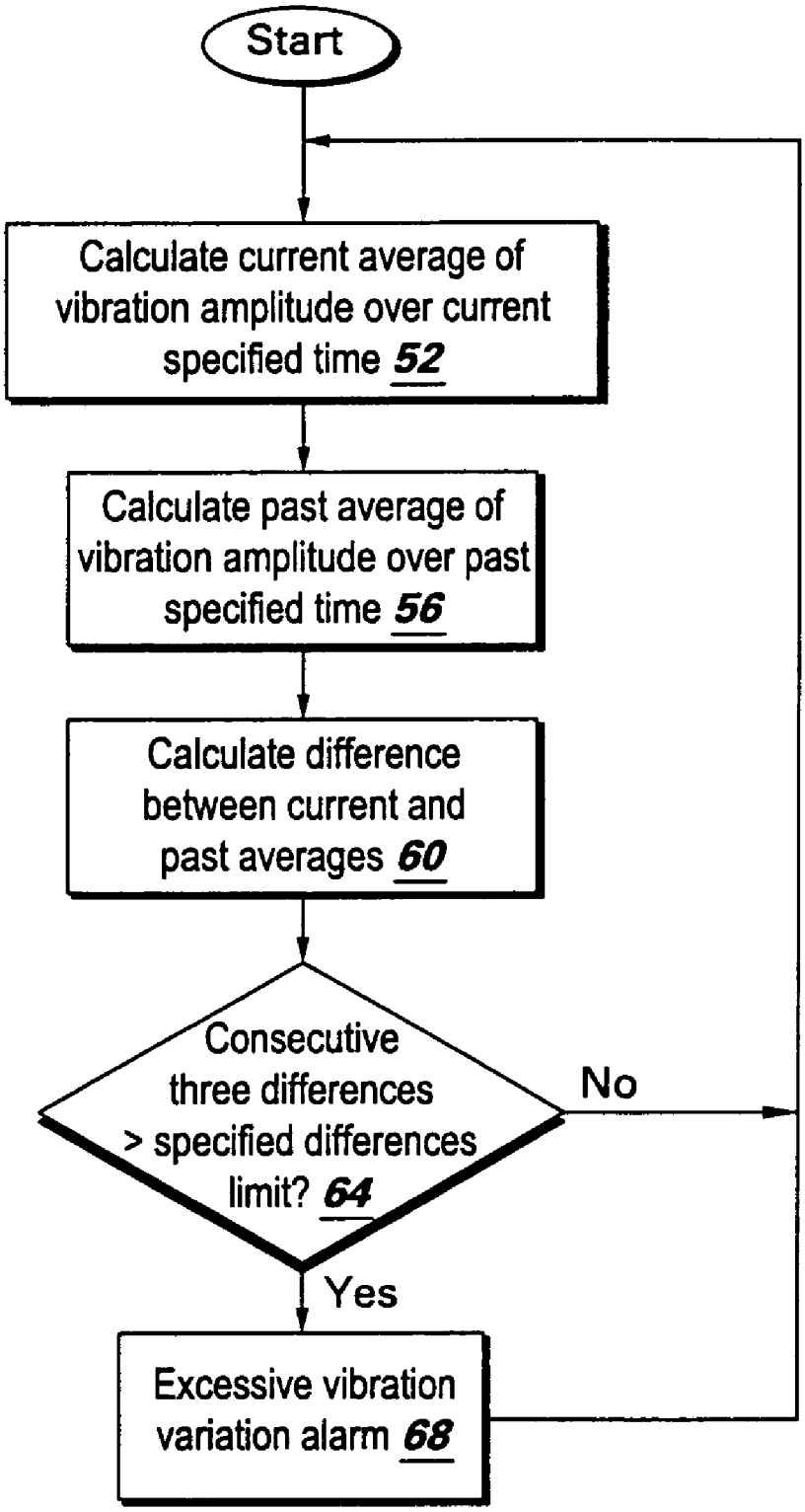
FIG. 3 depicts a flowchart illustrating a method for determining whether there is a change in vibration variance.
Figure 4:
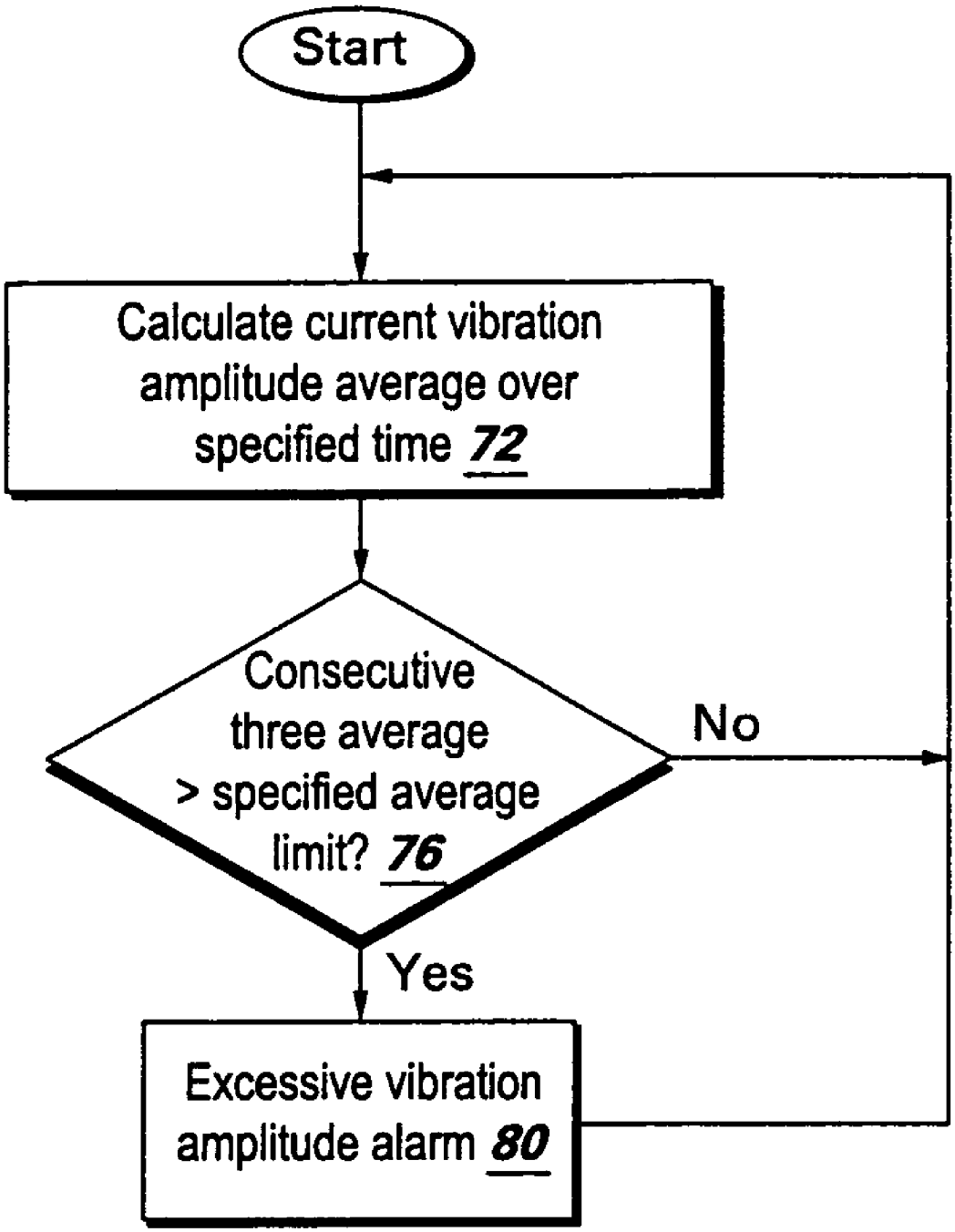
FIG. 4 depicts a flowchart illustrating a method for determining whether there is change in vibration amplitude.

FIGS. 3 and 4 show an embodiment of the disclosed method relating to the determining of whether there has been an abnormal change in vibration. An abnormal vibration change means a high variance in vibration amplitude or a high vibration amplitude. In an embodiment, both methods described in FIGS. 3 and 4 are used to concurrently determine whether there has been an abnormal change in vibration. Referring to FIG. 3, at process block 52 the current average amplitude of vibration is calculated for a current specified time. At act 56, the past average of amplitude of vibration over a past specified time is calculated. In an embodiment, the current specified time may be from −60 seconds to 0 seconds, where 0 seconds is the current instantaneous time. The past specified time may be from −120 seconds to −60 seconds. At act 60, the difference between the current and past averages are calculated, and at act 64 it is determined whether three consecutive calculated differences are above a specified limit. In one embodiment, the specified limit may be 1 mil of vibration amplitude change in 60 seconds. If three consecutive calculated differences are above a specified limit, then at act 68, an excessive vibration variation indicated.

Referring to FIG. 4, at act 72, the current vibration amplitude average over a specified time is calculated. In an embodiment, the specified time would be 5 samples or 10 seconds. At query 76, it is determined whether three consecution averages were above specified limits. In one embodiment the specified limits may be 7.5 mils for an upper limit and 5.5 mils for a lower limit. If it is determined that three consecutive averages are above the specified limits, then an excessive vibration amplitude would be indicated at act 80.

Rub Associated with High Vibration Response to First Critical Speed

Figure 5:
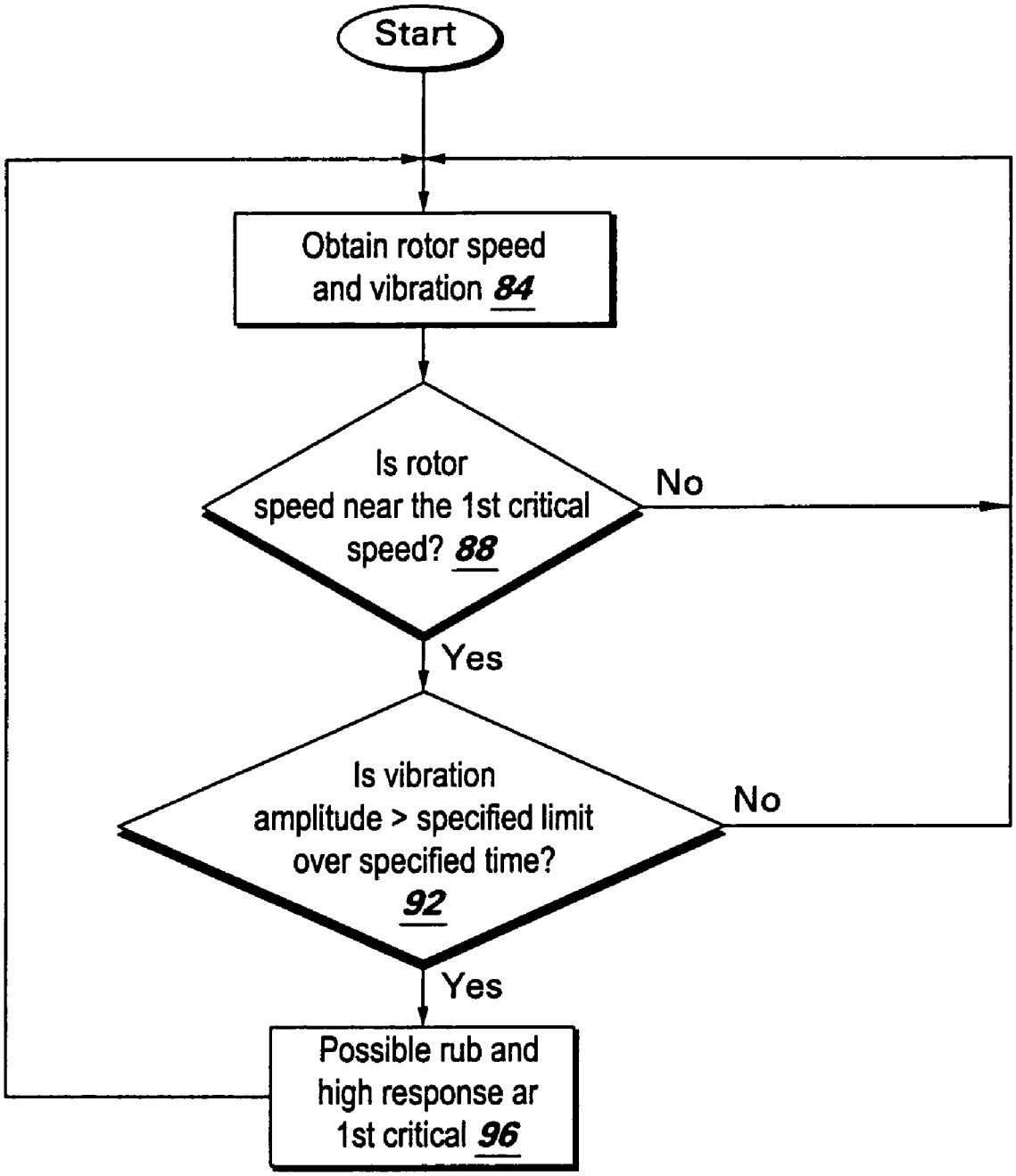
FIG. 5 depicts a flowchart illustrating a method for determining whether there is a rub associated with a high response to first critical speed.

FIG. 5 shows a flow chart that represents an embodiment of the disclosed method which detects a possible rub event from a high vibration response to the turbomachine's first critical speed. At act 84 the on site monitor obtains data indicating rotor speed and vibration. At query 88 it is determined whether the rotor speed is near the first critical speed. In one embodiment, a rotor speed will determined to be near its critical speed if it is within 20% of its critical speed. At query 92 it is determined whether vibration amplitude is greater than a specified limit over a specified time. In one embodiment, this specified limit and time would be 10 mils over 4 seconds. If it is determined that a vibration amplitude is greater than a specified limit over a specified time, then at act 96 a possible rub and high response at first critical is indicated.

Rub Associated with High Vibration Response to Second Critical Speed

Figure 6:
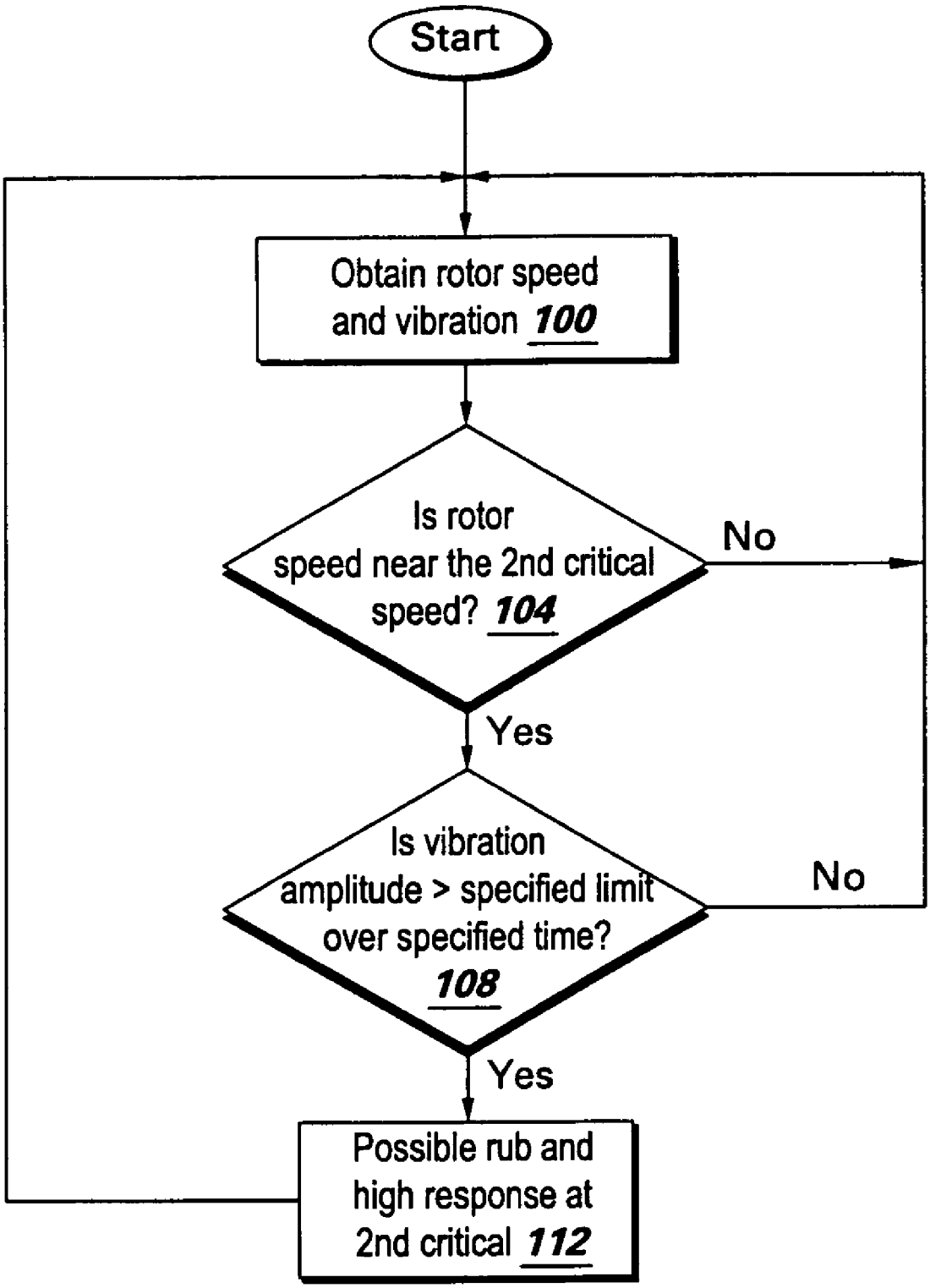
FIG. 6 depicts a flowchart illustrating a method for determining whether there is a rub associated with a high response to second critical speed.

FIG. 6 shows a flow chart that represents an embodiment of the disclosed method which detects a possible rub event from a high vibration response to the turbomachine's second critical speed. At act 100 the on site monitor obtains data indicating rotor speed and vibration. At query 104 it is determined whether the rotor speed is near the second critical speed. In one embodiment, a rotor speed is near its second critical speed if it is within 20% of its critical speed. At query 108 it is determined whether vibration amplitude is greater than a specified limit over a specified time. In one embodiment, a specified limit and specified time may be 10 mils over 4 seconds. If it is determined that a vibration amplitude is greater than a specified limit over a specified time, then at act 112 a possible rub and high response at second critical is indicated.

Rub Associated with Unsteady Vibration Affected by Load

Figure 7:
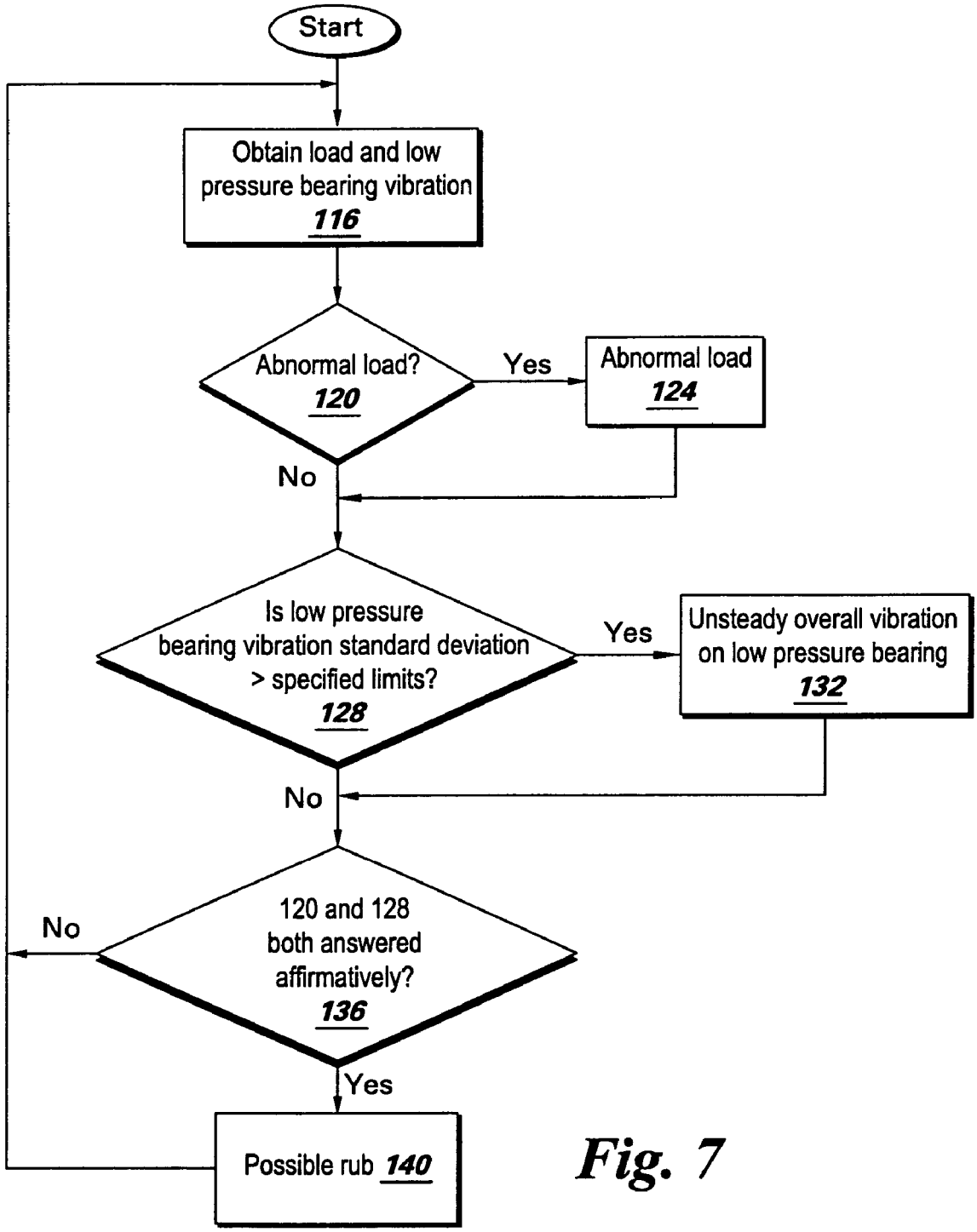
FIG. 7 depicts a flowchart illustrating a method for determining whether there is a rub associated with an unsteady vibration affected by load.

FIG. 7 shows a flow chart that represents an embodiment of the disclosed method which detects a possible rub event from unsteady vibration amplitude associated with abnormal amplitude or abnormal change in load. At act 116, the on site monitor obtains data indicating load, and vibration at the low pressure bearing. At query 120, it is determined whether there is an abnormal load. In an embodiment, abnormal load would be indicated when there is a larger than specified change in amplitude over a specified time period or if amplitude of the load exceeds specified limits. In an embodiment, the specified change in amplitude of load over a specified time would be 7 MW over 60 seconds. If there is an abnormal load detected, then at act 124, an abnormal load is indicated. At query 128 it is determined whether the standard deviation of the bearing vibration amplitude is greater than specified limits. In one embodiment, standard deviation would be calculated for 600 seconds, and a specified vibration amplitude limit would be 0.8 mils. If the bearing vibration's standard deviation is higher than specified limits, then an unsteady overall vibration on bearing will be indicated at act 132. At query 136 it is determined whether queries 120 and 128 were both answered affirmatively. If queries 120 and 128 were both answered affirmatively, then a possible rub is indicated at act 140.

Rub Associated with Unsteady Vibration Affected by Condenser Pressure

Figure 8:
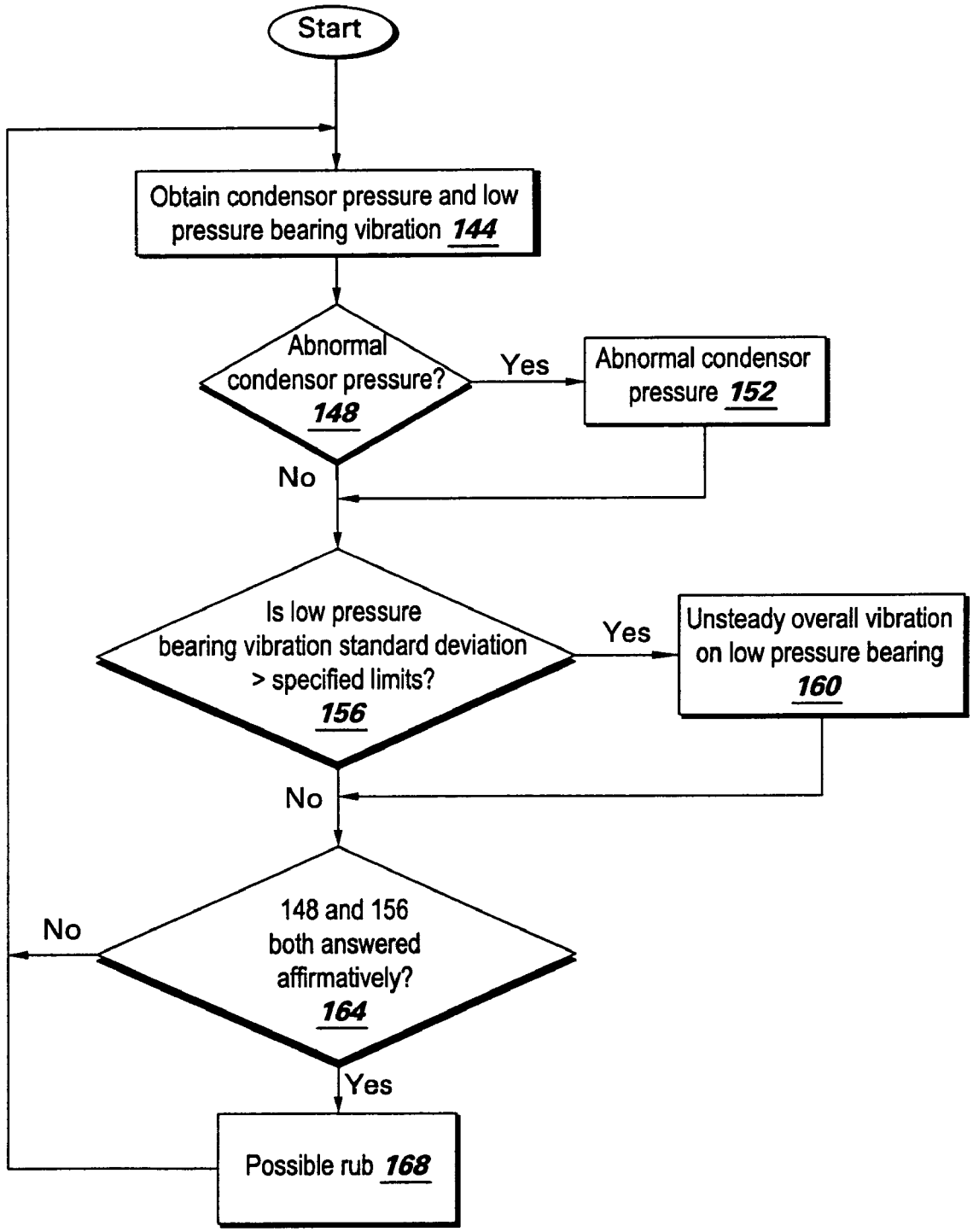
FIG. 8 depicts a flowchart illustrating a method for determining whether there is a rub associated with an unsteady vibration affected by condenser pressure.

FIG. 8 shows a flow chart that represents an embodiment of the disclosed method which detects a possible rub event from unsteady vibration amplitude associated with abnormal amplitude or abnormal change in condenser pressure. At act 144, the on site monitor obtains data indicating load, and vibration at the bearing. At query 148, it is determined whether there is an abnormal condenser pressure. In an embodiment, abnormal condenser pressure would be indicated when there is a larger than specified change in amplitude over a specified time period or if amplitude of the load exceeds specified limits. In an embodiment, the specified change over a specified time period would be 4 MM of HG in 60 seconds, and the specified amplitude limit would be 8 MM for a lower limit and 10 MM for a higher limit. If there is an abnormal condenser pressure detected, then at act 152, an abnormal condenser pressure is indicated. At query 156 it is determined whether the standard deviation of the bearing vibration amplitude is greater than specified limits. In one embodiment, standard deviation would be calculated for 600 seconds, and a specified vibration amplitude limit would be 0.8 mils. If the bearing vibration's standard deviation is higher than specified limits, then an unsteady overall vibration on bearing will be indicated at act 160. At query 164 it is determined whether queries 148 and 156 were both answered affirmatively. If queries 148 and 156 were both answered affirmatively, then a possible rub will be indicated at act 168.

Rub Associated with Vibration Affected by High Differential Expansion

Figure 9:
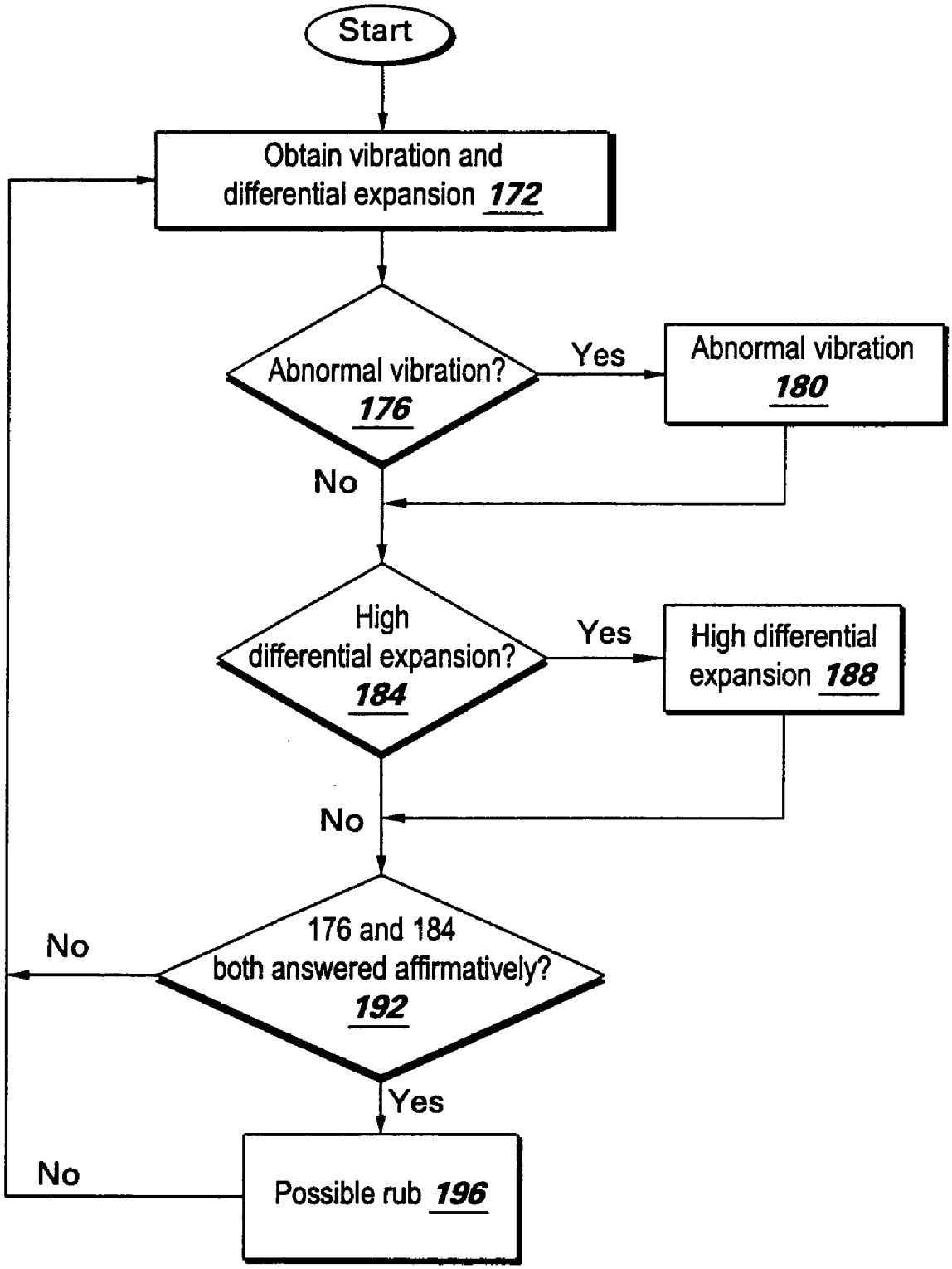
FIG. 9 depicts a flowchart illustrating a method for determining whether there is a rub associated with a vibration affected by a high differential expansion.

FIG. 9 shows a flow chart that represents an embodiment of the disclosed method which detects a possible rub event from abnormal vibration associated with high differential expansion. At act 172 the on site monitor obtains data indicating vibration and differential expansion. At query 176, it is determined whether there is abnormal vibration. If there is abnormal vibration, then at act 180 an abnormal vibration is indicated. At query 184 it is determined whether there is high differential expansion. In one embodiment, the on site monitor 12 records the logical tag for whether there is a high differential expansion from the turbine controller. If the value of the tag is equal to '1' then it is determined as high differential expansion. If there is high differential expansion, then at act 188, a high differential expansion is indicated. At query 192, it is determined whether both queries 176 and 184 were answered in the affirmative. If both queries 176 and 184 were answered in the affirmative then at act 194 a possible rub is indicated.

Possible Rub Determined by Abnormal Eccentricity, First Method

Figure 10:
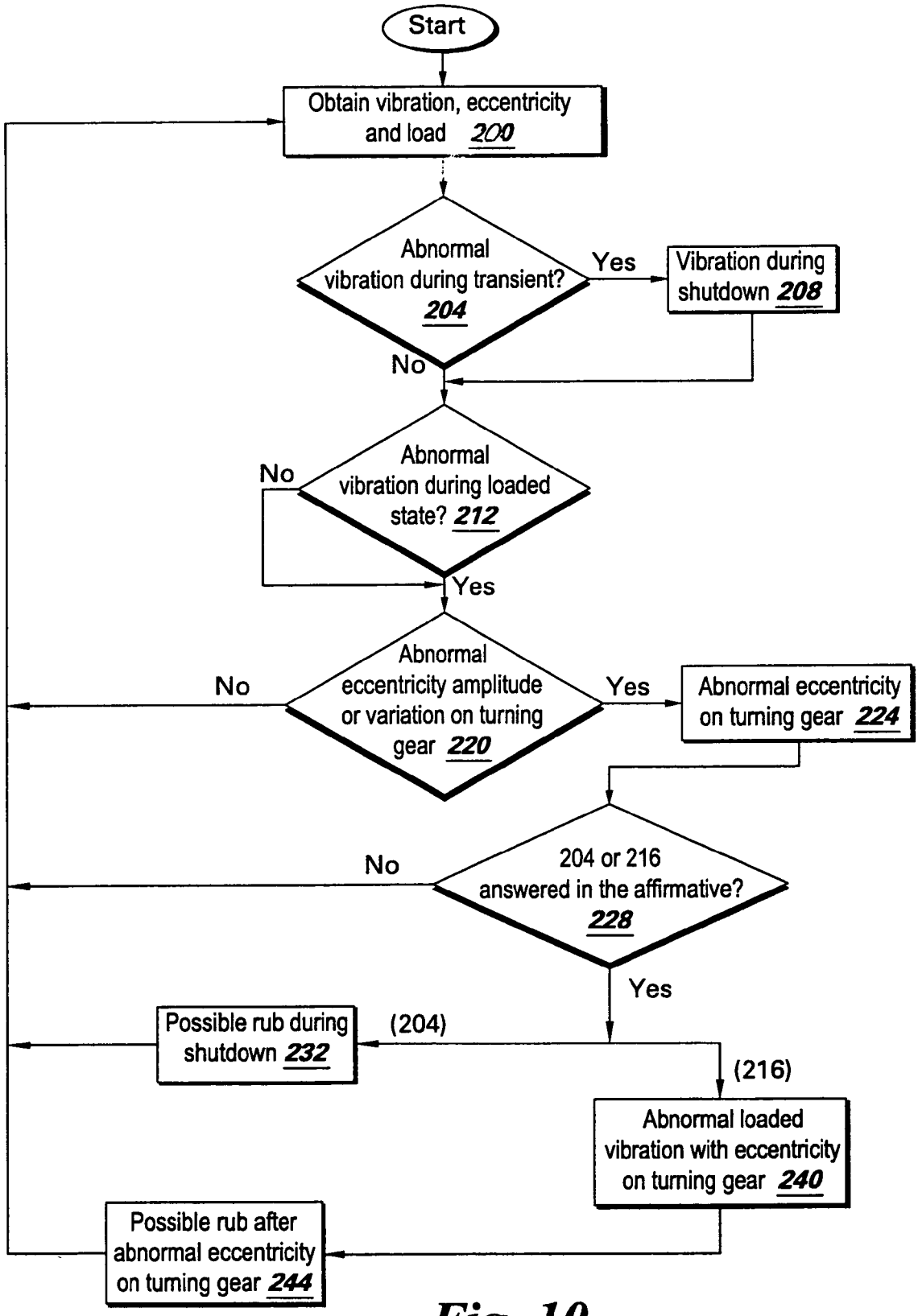
FIG. 10 depicts a flowchart illustrating a method for determining whether there is a rub associated with an abnormal eccentricity by a first method.

FIG. 10 shows a flow chart that represents a first embodiment of the disclosed method which detects a possible rub event associated with abnormal eccentricity. At act 200 the on site monitor obtains data indicating vibration, eccentricity and load. At query 204 it is determined whether there has been abnormal vibration during a transient. A transient is when the turbomachine is going through startup or shut down and until breaker condition is 'open'. At query 216 it is determined whether there has been abnormal vibration during a loaded state. At query 220 it is determined whether there is abnormal eccentricity while on turning gear. The turning gear consists of an electric motor connected to the turbomachine shaft and used to rotate the turbomachine shaft(s) and reduction gears at very low speeds. In an embodiment, abnormal eccentricity may be indicated when either (1) the eccentricity amplitude is above specified limits or (2) there is a larger than specified change in amplitude over a specified time period such as 10 seconds. Specified limits for some turbomachines may be 2 mils for a lower limit and 3 mils for a higher limit. If there is abnormal eccentricity while on turning gear, then at act 224 an abnormal eccentricity on turning gear is indicated. At query 228 it is determined whether query 204 or 216 was answered in the affirmative. If query 204 was answered in the affirmative, then a possible rub during shutdown is indicated at act 232. If query 216 was answered affirmatively, then an abnormal vibration during loaded condition with eccentricity during turning gear is indicated at act 240. At act 244 a possible rub after abnormal eccentricity on turning gear is indicated.

Possible Rub Determined by Abnormal Eccentricity, Second Method

Figure 11:
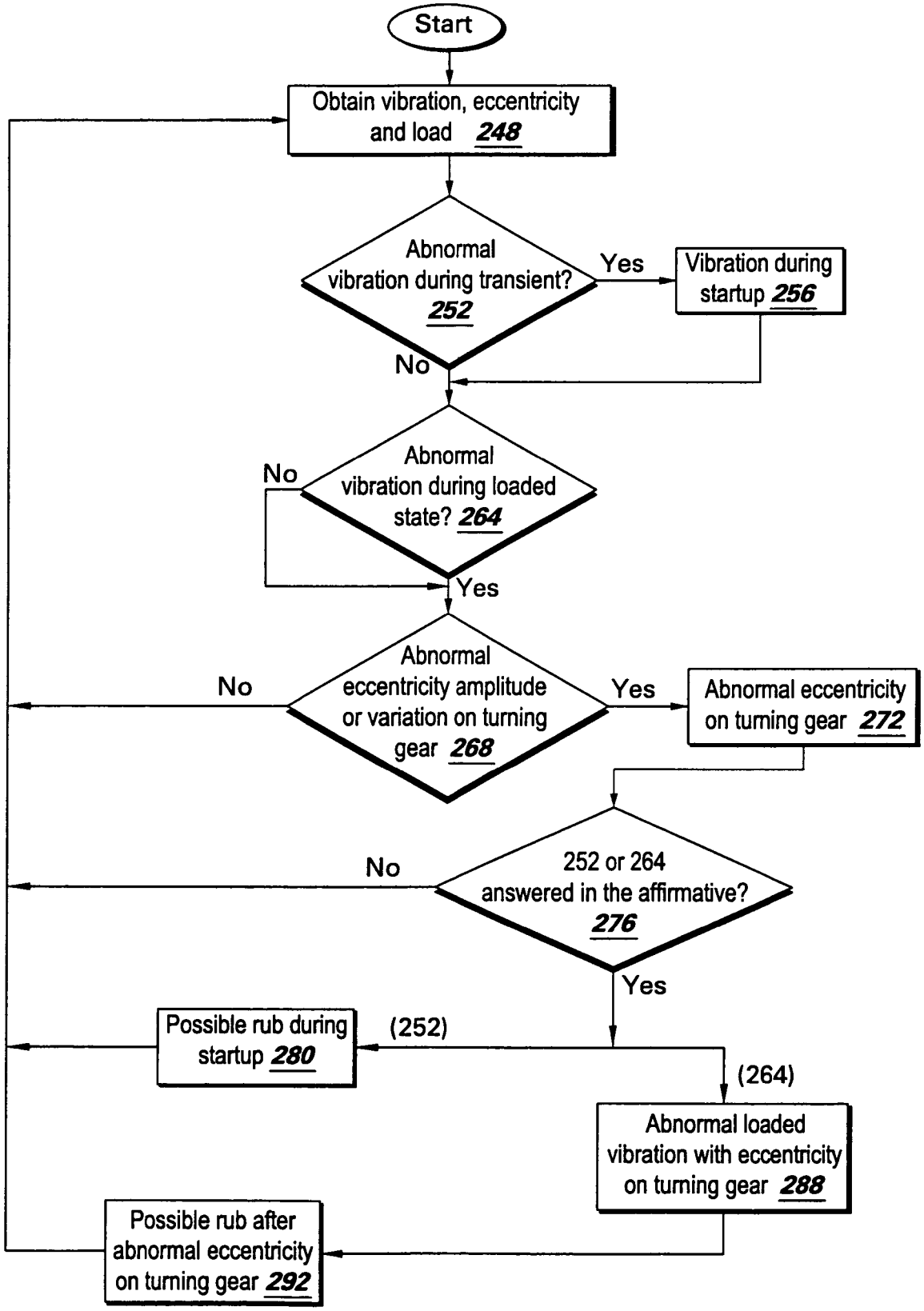
FIG. 11 depicts a flowchart illustrating a method for determining whether there is a rub associated with an abnormal eccentricity by a second method.

FIG. 11 shows a flow chart that represents a second embodiment of the disclosed method which detects a possible rub event associated with abnormal eccentricity. At act 248 the on site monitor obtains data indicating vibration, eccentricity and loading. At query 252 it is determined whether there has been abnormal vibration during a transient. If there has been abnormal vibration during transient, then an abnormal vibration during startup is indicated at act 256. At query 264 it is determined whether there has been abnormal vibration during a loaded state. At query 268 it is determined whether there is abnormal eccentricity while on turning gear. In an embodiment, abnormal eccentricity may be indicated when either (1) the eccentricity amplitude is above specified limits or (2) there is a larger than specified change in amplitude over a specified time period such as 10 seconds. If there is abnormal eccentricity while on turning gear, then at act 272 an abnormal eccentricity on turning gear is indicated. At query 276 it is determined whether query 252 or 264 was answered in the affirmative. If query 252 was answered in the affirmative, then a possible rub during startup is indicated at act 280. If query 264 was answered affirmatively, then an abnormal vibration during loaded condition with eccentricity during turning gear is indicated at act 288. At act 292 a possible rub after abnormal eccentricity on turning gear is indicated.

Possible Rub Associated with Vibration Change at Steady Speed

Figure 12:
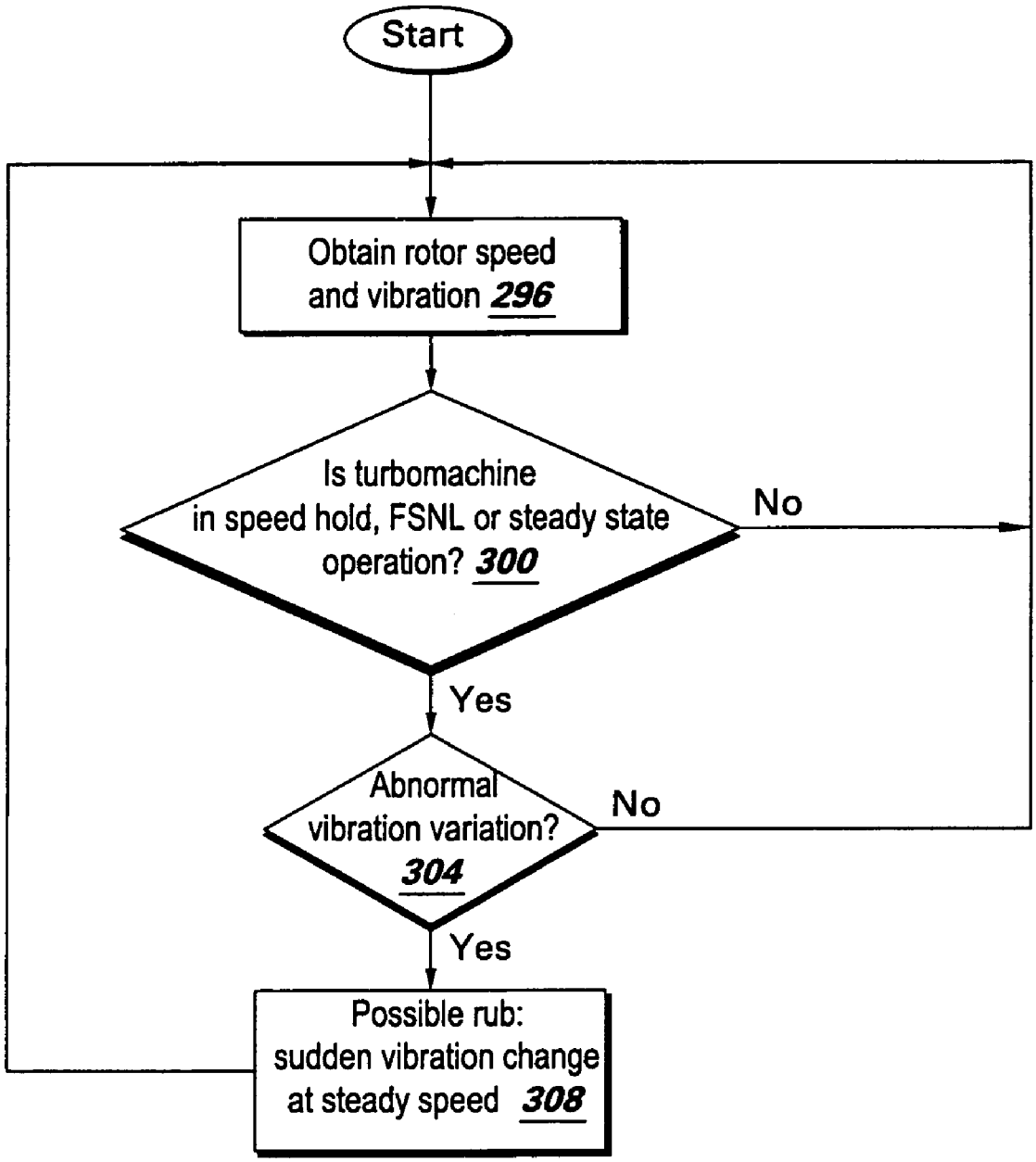
FIG. 12 depicts a flowchart illustrating a method for determining whether there is a rub associated with a vibration change at steady speed.

FIG. 12 shows a flow chart that represents an embodiment of the disclosed method which detects a possible rub event associated with a vibration change at steady speed. At act 296, the on site monitor obtains data indicating rotor speed and vibration. At query 300, it is determined whether the turbomachine is in a speed hold, fixed speed no load (FSNL), or stead state operation. In one embodiment, when a turbomachine is in a speed hold operating mode, then the maximum speed variation is about 10 rpm in about 60 seconds, and when a turbomachine is in a FSNL mode, then the maximum speed variation is about 2 rpm in about 60 seconds, and when a turbomachine is in a steady state mode, then the maximum speed variation is about 0.25% of rated rpm over about 900 seconds. At query 304 it is determined whether there is an abnormal vibration variation. In an embodiment abnormal vibration variation is determined by the method disclosed in FIG. 3. If abnormal vibration variation is found, then at act 308 a possible rub: sudden vibration at steady speed is indicated.

Possible Rub Associated With High Axial Vibration Standard Deviation

Figure 13:
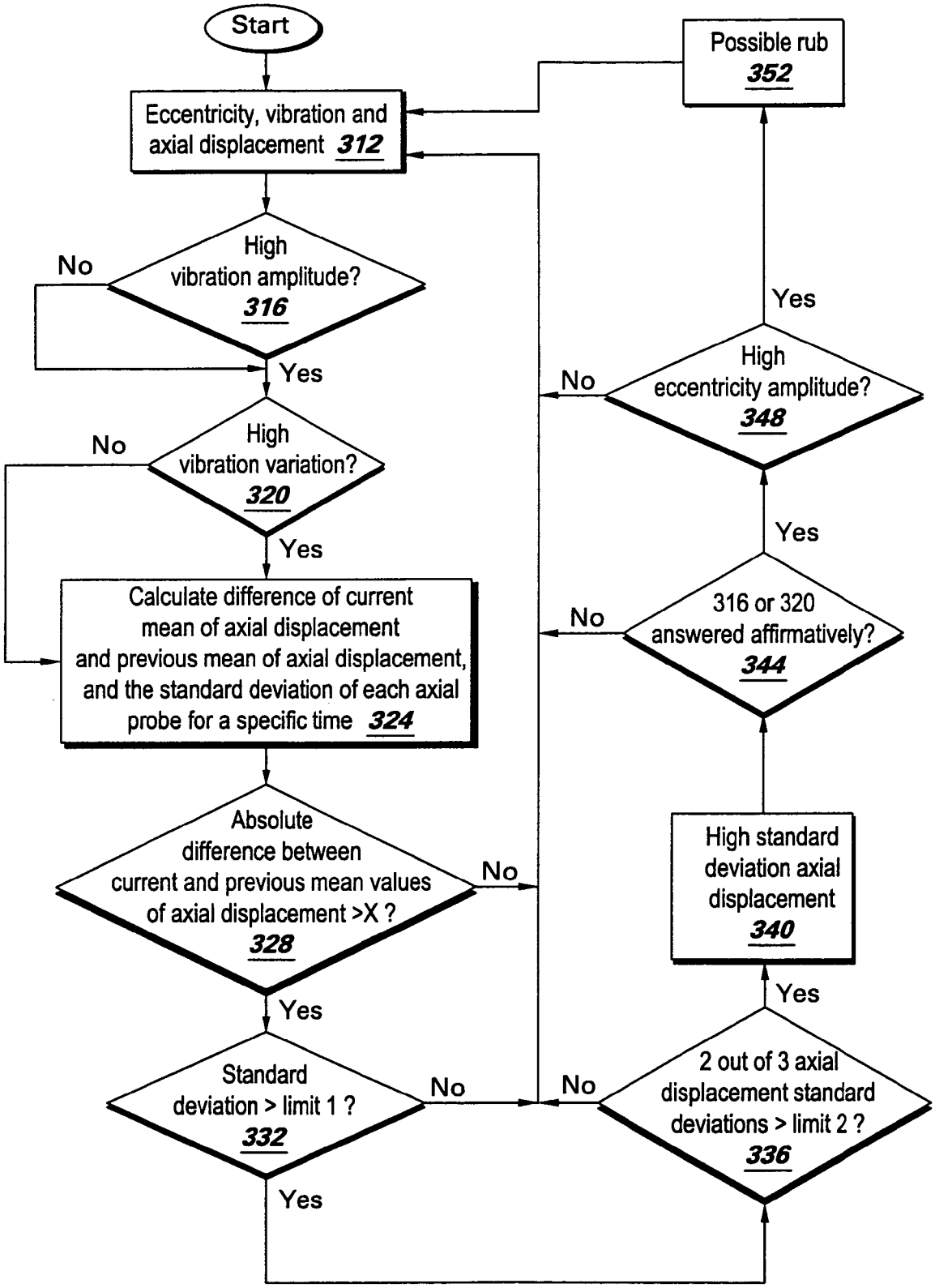
FIG. 13 depicts a flowchart illustrating a method for determining whether there is a rub associated with a high axial vibration standard deviation.

FIG. 13 shows a flow chart that represents an embodiment of the disclosed method which detects a possible rub event associated with high axial vibration standard deviations. At act 312 the on site monitor obtains data indicating eccentricity, vibration and axial vibration. At query 316, it is determined whether there is high vibration amplitude. At query 320 it is determined whether there is high vibration variation. At act 324, the current mean of axial displacement, the previous mean of axial displacement, and the standard deviation over a specified time limit of each of the axial probes are all calculated. In an embodiment, the current mean of the axial displacement may be taken during a time period from −60 seconds to 0 seconds, where 0 seconds is the current instantaneous time. The previous mean would be taken during a time period from −120 seconds to −60 seconds. Also, in an embodiment, the specified time limit may be 30 seconds. At query 328 it is determined whether an absolute difference between the current mean of axial displacement and the previous mean of axial displacement is less than "X", where X is a specified limit. In an embodiment of the invention, X may be 2 mils (2 thousandths of an inch). At query 332, it is determined whether standard deviation of any of the axial probes is greater than "Limit1", where Limit1 is a specified limit for a standard deviation of the axial displacement. In an embodiment, Limit1 may be 5 mils. At query 336 it is determined whether at least 2 out of 3 of the axial displacement standard deviations are greater than a "Limit2", where Limit2 is a specified limit for standard deviation of the axial displacement. In an embodiment, Limit2 may be 5 mils, which is the same as Limit1. However, in different embodiments Limit1 and Limit2 may be unequal to each other. This may allow for flexibility in determining what conditions are more likely to lead to a rub in turbomachines. If at least 2 out of 3 of the axial displacement standard deviations are greater than Limit2, then at act 340, a high standard deviation axial displacement is indicated. At query 344 it is determined whether either queries 316 and 320 were answered affirmatively. If either queries 316 or 320 were answered affirmatively, then at query 348 it is determined whether a high eccentricity amplitude is measured. If a high eccentricity amplitude is measured, then at act 352 a possible rub is indicated.

Rub Detection Overview

Figure 14:
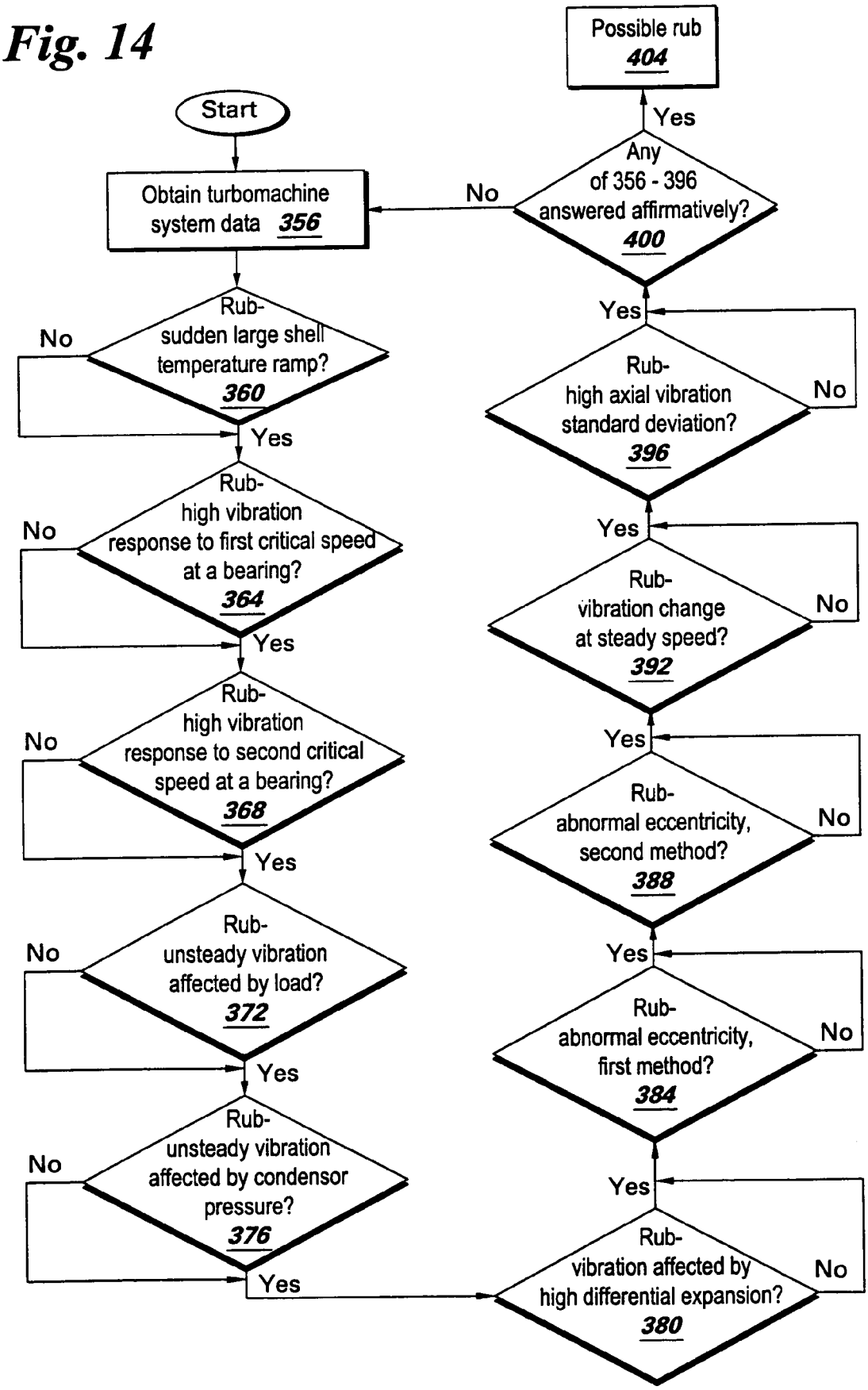
FIG. 14 depicts a flowchart illustrating a summary method for determining whether there is a rub.

FIG. 14 shows a flow chart that represents an overview embodiment of the disclosed methods for detecting rub in a turbomachine. At act 356 the on site monitor obtains data indicating the turbomachine system. At query 360, it is determined whether there is a possible rub associated with a sudden large shell temperature ramp. One embodiment of determining a rub in this case is discussed with respect to FIG. 2. At query 364 it is determined whether there is a possible rub associated with a high vibration response to the first critical speed. One embodiment of determining a rub in this case is discussed with respect to FIG. 5. At query 368 it is determined whether there is a possible rub associated with a high vibration response to the second critical speed. One embodiment of determining a rub in this case is discussed with respect to FIG. 6. At query 372 it is determined whether there is a rub associated with an unsteady vibration affected by load. One embodiment of determining a rub in this case is discussed with respect to FIG. 7. At query 376 it is determined whether there is a rub associated with an unsteady vibration affected by condenser pressure. One embodiment of determining a rub in this case is discussed with respect to FIG. 8. At query 380 it is determined whether there is a rub associated with vibration affected by high differential expansion. One embodiment of determining a rub in this case is discussed with respect to FIG. 9. At query 384 it is determined whether there is a rub associated with an abnormal eccentricity using a first method. One embodiment of determining a rub in this case is discussed with respect to FIG. 10. At query 388 it is determined whether there is a rub associated with an abnormal eccentricity using a second method. One embodiment of determining a rub in this case is discussed with respect to FIG. 11. At query 392 it is determined whether there is a rub associated with a vibration change at steady speed. One embodiment of determining a rub in this case is discussed with respect to FIG. 12. At query 396 it is determined whether there is a rub associated with a high axial vibration standard deviation. One embodiment of determining a rub in this case is discussed with respect to FIG. 13. At query 400 it is determined whether any of queries 356-396 were answered affirmatively. If any bocks were answered affirmatively, then a possible rub is indicated at act 404.

The present invention may be embodied in the form of computer-implemented processes and apparatuses for practicing those processes. The present invention may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

A technical contribution for the disclosed embodiments is the providing of automatic detection of possible rub events using standard sensors and data usually already installed on and around a turbomachine and communicated to an on site monitoring system. The disclosed embodiments do not require costly hardware for vibration signal conditioning for rub detection. For example phase angle data and the expensive equipment required to obtain phase angle data are not necessary for the disclosed embodiments. Instead, standard peak to peak unfiltered vibration may be used to determine possible rub events. Other advantages of the disclosed embodiments are that quick notification of possible rub events are provided, and with analysis of the obtained data, engineers and operators may prevent future rubs in the turbomachinery system.

While the embodiments of the disclosed method and apparatus have been described with reference to exemplary embodiments, it will be understood by those skilled in the art that various changes may be made and equivalents may be substituted for elements thereof without departing from the scope of the embodiments of the disclosed method and apparatus. In addition, many modifications may be made to adapt a particular situation or material to the teachings of the embodiments of the disclosed method and apparatus without departing from the essential scope thereof. Therefore, it is intended that the embodiments of the disclosed method and apparatus not be limited to the particular embodiments disclosed as the best mode contemplated for carrying out the embodiments of the disclosed method and apparatus, but that the embodiments of the disclosed method and apparatus will include all embodiments falling within the scope of the appended claims.

The invention claimed is:

1. A system for detecting a rub in a turbomachine comprising;

a turbomachine comprising a rotor, a stator, and a plurality of blades extending radially from the rotor, or the stator, or a combination thereof;

sensors configured to monitor turbomachine conditions; and an on site-monitor in communication with the sensors, wherein the on-site monitor is configured to analyze the turbomachine conditions to identify abnormal behavior indicative of a rub in at least near real time in the turbomachine between tip portions of the plurality of blades and corresponding seal portions of the turbomachine;

wherein the abnormal behavior comprises a high vibration amplitude relative to a baseline, or a high variation in vibration amplitude, or a sudden change in vibration amplitude, or a combination thereof.

2. The system of claim 1 further comprising a server in communication with the on site monitor via an internet.

3. The system of claim 1, wherein the plurality of blades is disposed on the rotor and the corresponding seal portions are disposed on the stator.

4. The system of claim 1, wherein the turbomachine conditions comprise bearing vibration, temperature, pressure, eccentricity, axial displacement, load, and condenser pressure values.

5. The system of claim 1, wherein the abnormal behavior comprises a sudden change in vibration values during steady speed operation, axial noisiness during coast down of the turbomachine, abnormal eccentricity value when the turbomachine returns to turning gear after a rub event during deceleration, abnormal vibration during start up followed by abnormal eccentricity when the turbomachine was on turning gear, abnormal vibration followed by abnormal upper and lower shell metal temperature difference, high vibration response to first critical speed, high vibration response to second critical speed, overall vibration affected by variation in load, overall vibration affected by variation in condenser pressure, or abnormal vibration during abnormal differential expansion of the stator and the rotor, or a combination thereof.

6. The system of claim 1, wherein the abnormal behavior comprises a sudden change in vibration amplitude.

7. A computer implemented method for detecting a rub in a turbomachine, the method comprising:

monitoring turbomachine conditions, wherein the turbomachine comprises a rotor, a stator, and a plurality of blades extending radially from the rotor, or the stator, or a combination thereof;

determining whether a rub is occurring between tip portions of the plurality of blades and corresponding seal portions of the turbomachine based at least in part on a high variation in vibration amplitude, or a sudden change in vibration amplitude, or a combination thereof; and outputting an indication of the rub to a computer display.

8. The system of claim 7, wherein the blades are disposed on the rotor, or the stator, or any combination thereof and the seals are disposed on the rotor, or the stator, or any combination thereof.

9. The system of claim 7, wherein the turbomachine conditions comprise bearing vibration, temperature, and pressure.

10. A storage medium encoded with a machine-readable computer program code for detecting whether a rub is occurring in a turbomachine, the storage medium including instructions for causing a computer to implement a method comprising:

obtaining data indicating turbomachine conditions, wherein the turbomachine comprises a rotor, a stator, and a plurality of blades extending radially from the rotor, or the stator, or a combination thereof;

determining whether a rub is occurring between tip portions of the plurality of blades and corresponding seal portions of the turbomachine in at least near real time based at least in part on an abnormal vibration relative to a historical trend, wherein the abnormal vibration comprises a sudden change in vibration amplitude; and outputting an indication of the rub to a computer display.

11. The system of claim 10, wherein the plurality of blades is disposed on the rotor and the corresponding seal portions are disposed on the stator.

12. The system of claim 10, wherein the turbomachine conditions comprise bearing vibration, or temperature, or axial displacement, or load, or condenser pressure values, or any combination thereof.

13. A system, comprising:

a turbomachine comprising a rotor, a stator, and a plurality of blades extending radially from the rotor, or the stator, or a combination thereof;

means for monitoring turbomachine conditions; and means for detecting whether a rub is occurring in the turbomachine between tip portions of the plurality of blades and corresponding seal portions of the turbomachine in at least near real time based on an abnormal vibration value, an abnormal eccentricity value, an abnormal response to a transient condition, an abnormal response to a variation in load, an abnormal response to a variation in pressure, or an abnormal differential expansion of the stator and the rotor, or a combination thereof.

14. The system of claim 13, wherein the plurality of blades is disposed on the rotor and the corresponding seal portions are disposed on the stator.

15. The system of claim 13, wherein the turbomachine conditions comprise temperature, eccentricity, load, and condenser pressure values.

16. A system, comprising:

a plurality of turbomachine sensors configured to couple to a turbomachine comprising a rotor, a stator, and a plurality of blades extending radially from the rotor, or the stator, or a combination thereof, wherein the plurality of turbomachine sensors is configured to sense operational parameters of the turbomachine; and a rub detection system configured to monitor the plurality of turbomachine sensors and to detect a turbomachine rub event occurring between tip portions of the plurality of blades and corresponding seal portions of the turbomachine based on one or more abnormal conditions, wherein the abnormal conditions comprise an abnormal vibration value, an abnormal eccentricity value, an abnormal response to a transient condition, an abnormal response to a variation in load, an abnormal response to a variation in pressure, and an abnormal differential expansion of the stator and the rotor.

17. The system of claim 16, wherein the plurality of blades is disposed on the rotor and the corresponding seal portions are disposed on the stator.

18. The system of claim 16, wherein the rub detection system is configured to monitor in real time.

19. A system, comprising:

a rub detection system configured to monitor operational parameters of a turbomachine comprising a rotor, a stator, and a plurality of blades extending radially from the rotor, or the stator, or a combination thereof, wherein the rub detection system is configured to detect a turbomachine rub event occurring between tip portions of the plurality of blades and corresponding seal portions of the turbomachine based on one or more abnormal conditions, wherein the abnormal conditions comprise a high vibration amplitude relative to a baseline, a high variation in vibration amplitude, and a sudden change in vibration amplitude.

20. The system of claim 19, comprising a turbomachine, wherein the rub detection system is coupled to the turbomachine.

21. The system of claim 19, wherein the plurality of blades is disposed on the rotor and the corresponding seal portions are disposed on the stator.

22. The system of claim 19, wherein the operational parameters comprise eccentricity, or axial displacement, or load, or condenser pressure values, or any combination thereof.

23. The system of claim 19, wherein rub detection system is configured to monitor in real time.

24. A computer implemented method, comprising:

analyzing turbomachine operational data to detect a rub event based on one or more abnormal conditions in the turbomachine, wherein the turbomachine comprises a rotor, a stator, and a plurality of blades extending radially from the rotor, or the stator, or a combination thereof, the rub event occurs between tip portions of the plurality of blades and corresponding seal portions of the turbomachine, and the one or more abnormal conditions comprise a high vibration amplitude, a high variation in vibration amplitude, a sudden change in vibration amplitude, an abnormal eccentricity value, an abnormal response to a transient condition, an abnormal response to a variation in load, an abnormal response to a variation in pressure, and an abnormal differential expansion of the stator and the rotor, and a combination thereof; and outputting an indication of the rub event to a computer display.

25. The method of claim 24, comprising monitoring a turbomachine to obtain the operational data.

26. The method of claim 24, wherein analyzing comprises detecting the rub event in real time with operation of a turbomachine.

27. The method of claim 24, wherein the plurality of blades is disposed on the rotor and the corresponding seal portions are disposed on the stator.

28. The method of claim 25, wherein monitoring comprises monitoring the turbomachine on-site.

29. The method of claim 25, wherein monitoring comprises monitoring the operational data in real time.

30. A system, comprising:

a turbomachine monitor configured to identify abnormal operational events as an indication of a rub in at least near real time between components of a turbomachine, wherein the abnormal operational events comprise an abnormal vibration value relative to a baseline.

31. The system of claim 30, wherein the abnormal operational events comprise a high vibration amplitude, a high variation in vibration amplitude, a sudden change in vibration amplitude, or a combination thereof.

32. The system of claim 30, wherein the abnormal operational events comprise an abnormal eccentricity amplitude and/or abnormal eccentricity change during turning of a component of the turbomachine.

33. The system of claim 30, wherein the abnormal operational events comprise abnormal behavior during the transient condition of a start up or a shut down of the turbomachine.

34. The system of claim 30, wherein the abnormal operational events comprise an abnormal load amplitude and/or abnormal load change associated with the turbomachine.

35. The system of claim 30, wherein the abnormal operational events comprise an abnormal pressure amplitude and/or abnormal pressure change associated with the turbomachine.

36. The system of claim 30, wherein the abnormal operational events comprise an abnormal amplitude and/or an abnormal change in a property of steam in the turbomachine.

37. The system of claim 30, wherein the abnormal operational events comprise the abnormal differential expansion of a stator and a rotor of the turbomachine.

38. The system of claim 30, wherein the abnormal operational events comprise the abnormal vibration value, the abnormal eccentricity value, the abnormal behavior associated with the transient condition, the abnormal behavior associated with the variation in load, the abnormal behavior associated with the variation in pressure, the abnormal steam characteristic of the turbomachine, and the abnormal differential expansion, each individually and in combinations with one another.

39. The system of claim 30, comprising the turbomachine having a plurality of sensors communicative with the turbomachine monitor.

40. The system of claim 30, wherein the turbomachine monitor is configured to monitor for the rub in at least near real time.

41. The system of claim 30, wherein the abnormal operational events comprise an abnormal eccentricity value, an abnormal behavior associated with a transient condition, an abnormal behavior associated with a variation in load, an abnormal behavior associated with a variation in pressure, an abnormal steam characteristic of the turbomachine, an abnormal differential expansion, or a combination thereof.

42. The system of claim 39, wherein the turbomachine comprises a rotor, a stator, and a plurality of blades extending radially from the rotor, or the stator, or a combination thereof, wherein the turbomachine monitor is configured to monitor the possibility of the rub between tip portions of the plurality of blades and corresponding seal portions of the turbomachine.

43. A system, comprising:

a turbomachine monitor configured to identify abnormal operational events as an indication of a rub between components of a turbomachine, wherein the abnormal operational events comprise a sudden change in vibration relative to a first baseline, a large variance in vibration relative to a second baseline, or a large vibration amplitude relative to a third baseline, or a combination thereof.

44. The system of claim 43, comprising the turbomachine having a plurality of sensors communicative with the turbomachine monitor.

45. The system of claim 43, wherein the turbomachine monitor is configured to monitor for the rub in at least near real time.

46. The system of claim 43, wherein the first, second, and third baselines are based on past data.

47. The system of claim 44, wherein the turbomachine comprises a rotor, a stator, and a plurality of blades extending radially from the rotor, or the stator, or a combination thereof, wherein the turbomachine monitor is configured to monitor the possibility of the rub between tip portions of the plurality of blades and corresponding seal portions of the turbomachine.

48. A system, comprising:

a turbomachine monitor configured to monitor for abnormal operational events to identify a possible rub between components of a turbomachine in at least near real time, wherein the abnormal operational events comprise a sudden change relative to a first baseline, or a high variation relative to a second baseline, or a high value relative to a third baseline, or a combination thereof, of an operational parameter of the turbomachine, wherein the operational parameter comprises vibration amplitude.

49. The system of claim 48, wherein the abnormal operational events comprise an abnormal eccentricity value, an abnormal behavior associated with a transient condition, an abnormal behavior associated with a variation in load, an abnormal behavior associated with a variation in pressure, an abnormal steam characteristic of the turbomachine, or an abnormal differential expansion, or a combination thereof.

50. The system of claim 48, wherein the abnormal operational events comprise an abnormal eccentricity value, an abnormal behavior associated with a transient condition, an abnormal behavior associated with a variation in load, an abnormal behavior associated with a variation in pressure, an abnormal steam characteristic of the turbomachine, and an abnormal differential expansion, each individually and in combinations with one another.

51. The system of claim 48, wherein the abnormal operational events comprise an abnormal eccentricity amplitude and/or abnormal eccentricity change during turning of a component of the turbomachine.

52. The system of claim 48, wherein the abnormal operational events comprise abnormal behavior during the transient condition of a start up or a shut down of the turbomachine.

53. The system of claim 48, wherein the abnormal operational events comprise an abnormal load amplitude and/or abnormal load change associated with the turbomachine.

54. The system of claim 48, wherein the abnormal operational events comprise an abnormal pressure amplitude and/or abnormal pressure change associated with the turbomachine.

55. The system of claim 48, wherein the abnormal operational events comprise an abnormal amplitude and/or an abnormal change in a property of steam in the turbomachine.

56. The system of claim 48, wherein the abnormal operational events comprise the abnormal differential expansion of a stator and a rotor of the turbomachine.

57. The system of claim 48, comprising the turbomachine having a plurality of sensors communicative with the turbomachine monitor.

58. The system of claim 57, wherein the turbomachine comprises a rotor, a stator, and a plurality of blades extending radially from the rotor, or the stator, or a combination thereof, wherein the turbomachine monitor is configured to monitor for the possible rub between tip portions of the plurality of blades and corresponding seal portions of the turbomachine.

* * * * *